US009174444B2

(12) United States Patent
Hirai et al.

(10) Patent No.: US 9,174,444 B2
(45) Date of Patent: Nov. 3, 2015

(54) LIQUID EJECTING HEAD AND LIQUID EJECTING APPARATUS

(71) Applicant: SEIKO EPSON CORPORATION, Tokyo (JP)

(72) Inventors: Eiju Hirai, Minowa-machi (JP); Yoshinao Miyata, Matsukawa-mura (JP); Yuma Fukuzawa, Matsumoto (JP); Motoki Takabe, Shiojiri (JP); Yue Gao, Matsumoto (JP); Shiro Yazaki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/627,779

(22) Filed: Feb. 20, 2015

(65) Prior Publication Data

US 2015/0239248 A1 Aug. 27, 2015

(30) Foreign Application Priority Data

Feb. 24, 2014 (JP) ..... 2014-032770

(51) Int. Cl.
*B41J 2/045* (2006.01)
*B41J 2/14* (2006.01)

(52) U.S. Cl.
CPC ..... *B41J 2/14274* (2013.01); *B41J 2/14233* (2013.01)

(58) Field of Classification Search
CPC ..... B41J 2/14201; B41J 2/14209; B41J 2/14233; B41J 2/14274
See application file for complete search history.

(56) References Cited

U.S. PATENT DOCUMENTS 5,997,135 A * 12/1999 Sugahara ..... 347/71
2007/0091149 A1 4/2007 Yazaki

FOREIGN PATENT DOCUMENTS

JP 2007-118193 5/2007

* cited by examiner

*Primary Examiner* — Juanita D Jackson
(74) *Attorney, Agent, or Firm* — Workman Nydegger

(57) ABSTRACT

Piezoelectric elements each have a configuration in which a lower electrode film, a piezoelectric body layer, and an upper electrode film are stacked in order from a side relatively near to a displacement portion that defines a pressure chamber by tightly closing a portion of a pressure chamber space that forms the pressure chamber. The lower electrode film is provided individually for each pressure chamber. The upper electrode film covers the lower electrode film and the piezoelectric body layer, and is common to the piezoelectric elements. The ratio of a length (L) of a displacement portion-side opening of each pressure chamber space in a direction orthogonal to a pressure chamber space juxtaposition direction to a width (W) of the displacement portion-side opening in the pressure chamber space juxtaposition direction is greater than or equal to 4.3 and less than or equal to 6.0.

12 Claims, 6 Drawing Sheets

FIG. 4

| L (μm) | 440 | 430 | 420 | 410 | 400 | 390 | 380 | 370 | 360 | 350 | 340 | 330 | 320 | 310 | 300 | 290 | 280 |
|---|---|---|---|---|---|---|---|---|---|---|---|---|---|---|---|---|---|
| L/W | 6.28 | 6.14 | 6.0 | 5.85 | 5.71 | 5.57 | 5.42 | 5.28 | 5.14 | 5.0 | 4.85 | 4.71 | 4.5 | 4.42 | 4.28 | 4.14 | 4.0 |
| DISPLACEMENT (nm) | 485 | 530 | 558 | 563 | 567 | 575 | 587 | 595 | 600 | 595 | 591 | 583 | 579 | 575 | 571 | 546 | 510 |
| RATE OF INCREASE (%) | 19 | 30 | 37 | 38 | 39 | 41 | 44 | 46 | 47 | 46 | 45 | 43 | 42 | 41 | 40 | 34 | 25 |

FIG. 5

| UPPER ELECTRODE FILM THICKNESS (nm) | 30 | 40 | 50 | 60 | 70 | 80 | 90 |
|---|---|---|---|---|---|---|---|
| DISPLACEMENT (nm) | 786 | 780 | 775 | 762 | 750 | 726 | 680 |
| RATE OF INCREASE (%) | 32 | 30 | 29 | 27 | 25 | 21 | 13 |

LIQUID EJECTING HEAD AND LIQUID EJECTING APPARATUS

The entire disclosure of Japanese Patent Application No: 2014-032770, filed Feb. 24, 2014 is expressly incorporated by reference herein in its entirety.

BACKGROUND

1. Technical Field

The present invention relates to a liquid ejecting head that ejects liquid by driving a piezoelectric element, and to a liquid ejecting apparatus including the liquid ejecting head. In particular, the invention relates to a liquid ejecting head that ejects liquid from a nozzle by displacing a displacement portion that defines a portion of a pressure chamber by driving a piezoelectric element, and to a liquid ejecting apparatus.

2. Related Art

A liquid ejecting apparatus includes a liquid ejecting head and ejects various types of liquid from the liquid ejecting head. Such liquid ejecting apparatuses include, for example, image recording apparatuses, such as, ink jet printers, ink jet plotters, etc., and have also recently been applied to various kinds of production apparatuses by making use of the feature that enables the apparatus to accurately deposit very small amounts of liquid at predetermined positions. Examples of use of liquid ejecting apparatuses in production apparatuses include a display production apparatus for producing a color filter for a liquid crystal display or the like, an electrode forming apparatus for forming electrodes of an organic electro-luminescence (EL) display, a surface emitting display (SED), etc., and a chip production apparatus for producing a bio-chip (biochemical device). While a recording head for an image recording apparatus ejects liquid inks, a color material ejecting head for a display producing apparatus ejects solutions of color materials of red (R), green (G), and blue (B). Furthermore, an electrode material ejecting head for an electrode forming apparatus ejects an electrode material in a liquid state, and a bioorganic material ejecting head for a chip production apparatus ejects a solution of a bioorganic material.

The aforementioned liquid ejecting heads are constructed to introduce a liquid into a pressure chamber, and eject the liquid from a nozzle communicating with the pressure chamber by causing pressure fluctuation in the liquid in the pressure chamber. The space that forms the aforementioned pressure chamber is formed with high dimensional accuracy by performing anisotropic etching on a crystalline substrate of silicon or the like. Furthermore, a piezoelectric element is preferably used as a pressure generator that causes pressure fluctuation in the liquid in the pressure chamber. The piezoelectric elements vary in terms of configuration. For example, a piezoelectric element has a configuration in which a lower electrode film at a side nearer to the pressure chamber, a piezoelectric body layer of lead zirconium titanate (PZT), etc., and an upper electrode film are stacked by using a film formation technology (see, e.g., JP-A-2007-118193). One of the upper electrode and the lower electrode functions as individual electrodes that are provided individually for each of a plurality of pressure chambers, and the other electrode functions as a common electrode that is common to the pressure chambers. In a piezoelectric body film, portions sandwiched between the upper and lower electrodes are active portions that deform when voltage is applied between the upper and lower electrodes, and portions not sandwiched between the electrodes, that is, portions apart from both or one of the upper and lower electrodes, are non-active portions that do not deform when voltage is applied between the electrodes. An opening portion of each pressure chamber that is formed in a side thereof (the opposite side of the pressure chamber to a nozzle surface side) is closed by an elastic film that is made of, for example, $SiO_2$, and that has flexibility. A piezoelectric element is formed on the elastic film, with an insulation film (made of, e.g., $ZrO_2$) provided therebetween. The elastic film and the insulation film function as a vibration plate.

An evaluation index of the performance of a liquid ejecting head as described above is an index termed expelled volume. Expelled volume means the amount of change in the capacity of a pressure chamber (the volume of liquid expelled from the pressure chamber) that occurs when the piezoelectric element is driven by applying a predetermined drive voltage. By increasing the expelled volume, the liquid can be more efficiently ejected from the nozzle. The approximate size of the expelled volume can be found by multiplying the area of an upper opening of the space that forms a pressure chamber and that is at the opposite side of the space to the nozzle (alternatively, the area of a portion of the vibration plate that tightly closes the upper opening of the space, the portion being capable of being displaced according to the driving of the piezoelectric element (hereinafter, referred to as "displacement portion", as appropriate)) by the amount of displacement (stroke) of the piezoelectric element that occurs when a predetermined drive voltage is applied. In the case of a relatively large liquid ejecting head (e.g., a liquid ejecting head whose nozzle formation pitch (center-to-center distance between adjacent nozzles) is 1/180 inch or greater, a relatively large capacity of each of the pressure chambers and a relatively large area of each of the upper openings can be secured, so that, accordingly, a relatively large expelled volume can be secured. On the other hand, in a small liquid ejecting head with an increased density of nozzles (e.g., a liquid ejecting head whose nozzle opening pitch is 1/300 or less), the width of each pressure chamber (a dimension thereof in the direction in which pressure chambers are juxtaposed) is smaller than in a large liquid ejecting head. Therefore, with regard to such small liquid ejecting heads, increasing the length of each pressure chamber (a dimension thereof in a direction orthogonal to the pressure chamber juxtaposition direction) is conceivable in order to secure a larger capacity of each pressure chamber and a larger area of each upper opening.

However, if the ratio of the length to the width of each pressure chamber is excessively high, the ease of movement of each displacement portion is impeded, so that the expelled volume deteriorates. Furthermore, there is a problem that the greater the length of the pressure chambers, the greater the dimensions of the liquid ejecting head in planar directions (directions parallel to the nozzle surface). Moreover, even if the amount of displacement of the piezoelectric elements is increased by contriving an electrode structure of the piezoelectric elements or a piezoelectric body structure, there remains a problem that if the displacement portions are not easily movable, the capability of the piezoelectric elements is not fully utilized.

SUMMARY

An advantage of some aspects of the invention is that it is possible to provide a liquid ejecting head that allows both size reduction of the head and an increase of the expelled volume, and a liquid ejecting apparatus.

A liquid ejecting head according to an aspect of the invention includes a pressure chamber-forming member provided with a plurality of spaces each of which communicates with a nozzle and forms a pressure chamber, and a piezoelectric element in which a first electrode, a piezoelectric body layer, and a second electrode are stacked in order from a side relatively near to a displacement portion that tightly closes an opening of at least one of the spaces formed in the pressure chamber-forming member and that defines a portion of the pressure chamber. The piezoelectric element is driven to displace the displacement portion so that pressure change is caused in a liquid within the pressure chamber and is utilized to eject the liquid from the nozzle. A ratio of a length of the opening in a direction orthogonal to a pressure chamber space juxtaposition direction in which the spaces are juxtaposed to a width of the opening in the pressure chamber space juxtaposition direction is greater than or equal to 4.3 and less than or equal to 6.0.

According to this configuration, since the ratio of the length to width of the displacement portion-side opening of the space that forms the pressure chamber is set within the range of 4.3 or greater to 6.0 or less, the displacement efficiencies of the piezoelectric element and the displacement portion can be improved even in the case where the opening area of the space that forms the pressure chamber is smaller than in the related art. Therefore, it becomes possible to increase the expelled volume that occurs at the time of driving the piezoelectric element, while reducing the capacity of the pressure chamber so as to allow size reduction of the recording head.

Furthermore, in the forgoing configuration, the first electrode may be provided individually for each pressure chamber, and the second electrode may extend over a plurality of piezoelectric elements in the pressure chamber space juxtaposition direction, cover the first electrode and the piezoelectric body layer of each piezoelectric element, and be common to the plurality of piezoelectric elements.

According to this configuration, the second electrode is formed, covering the first electrode and the piezoelectric body layer of each piezoelectric element. Therefore, the second electrode functions as a protective layer that protects the piezoelectric body layer in an active portion from moisture in air or the like. Therefore, there is no longer need to separately provide a protective layer, and the thickness of the piezoelectric elements can be correspondingly reduced. Due to this, the displacement of the piezoelectric elements improves, contributing to an increase of the expelled volume.

Furthermore, in the foregoing configuration, a film thickness of the second electrode may be 100 [nm] or less.

This configuration contributes to improvement in the displacement efficiencies of the piezoelectric elements and the displacement portions. Therefore, it becomes possible to further increase the expelled volume.

Furthermore, in the foregoing configuration according to the invention, a plurality of nozzles may be formed at a formation pitch of 1/300 inch or less.

In the foregoing configuration, a thickness of the second electrode may be greater than or equal to 30 [nm] and less than or equal to 70 [nm].

According to this configuration, because the thickness of the second electrode is set within the range of 30 [nm] or greater to 70 [nm] or less, it is possible to further improve the displacement of the piezoelectric elements without causing a problem such as electrode destruction at the time of driving the piezoelectric element. This further enhances the displacement efficiencies of the piezoelectric elements and the displacement portions. Therefore, this contributes to a further increase of the expelled volume.

In the foregoing configuration, the ratio of the length of the opening of the space to the width of the opening may be 5.14.

According to this configuration, the displacement efficiencies of the piezoelectric elements and the displacement portions can be more effectively enhanced. Therefore, it becomes possible to further increase the expelled volume.

Furthermore, according to other aspects of the invention, a liquid ejecting apparatus includes a liquid ejecting head that has any one of the foregoing configurations.

BRIEF DESCRIPTION OF THE DRAWINGS

The invention will be described with reference to the accompanying drawings, wherein like numbers reference like elements.

FIG. 4 is a table showing dimensions of upper openings of pressure chamber spaces, amounts of displacement of piezoelectric elements and displacement portions, and rates of increase in the amount of displacement compared with a comparative example.

FIG. 5 is a table showing thicknesses of upper electrode films, amounts of displacement of piezoelectric elements and displacement portions, and rates of increase in the amount of displacement compared with a comparative example.

DESCRIPTION OF EXEMPLARY EMBODIMENTS

Exemplary embodiments of the invention will be described hereinafter with reference to the drawings. Incidentally, the embodiments described below are provided with various limitations as preferred concrete examples of the invention. However, the scope of the invention is not limited to these embodiments or the like described below unless it is mentioned in the following description that the invention is particularly limited. Furthermore, in the following description, ink jet printers (hereinafter, referred to as "printer") equipped with an ink jet recording head (hereinafter, referred to as "recording head"), which is a kind of liquid ejecting head, will be cited as examples of liquid ejecting apparatuses according to the invention.

Figure 1:
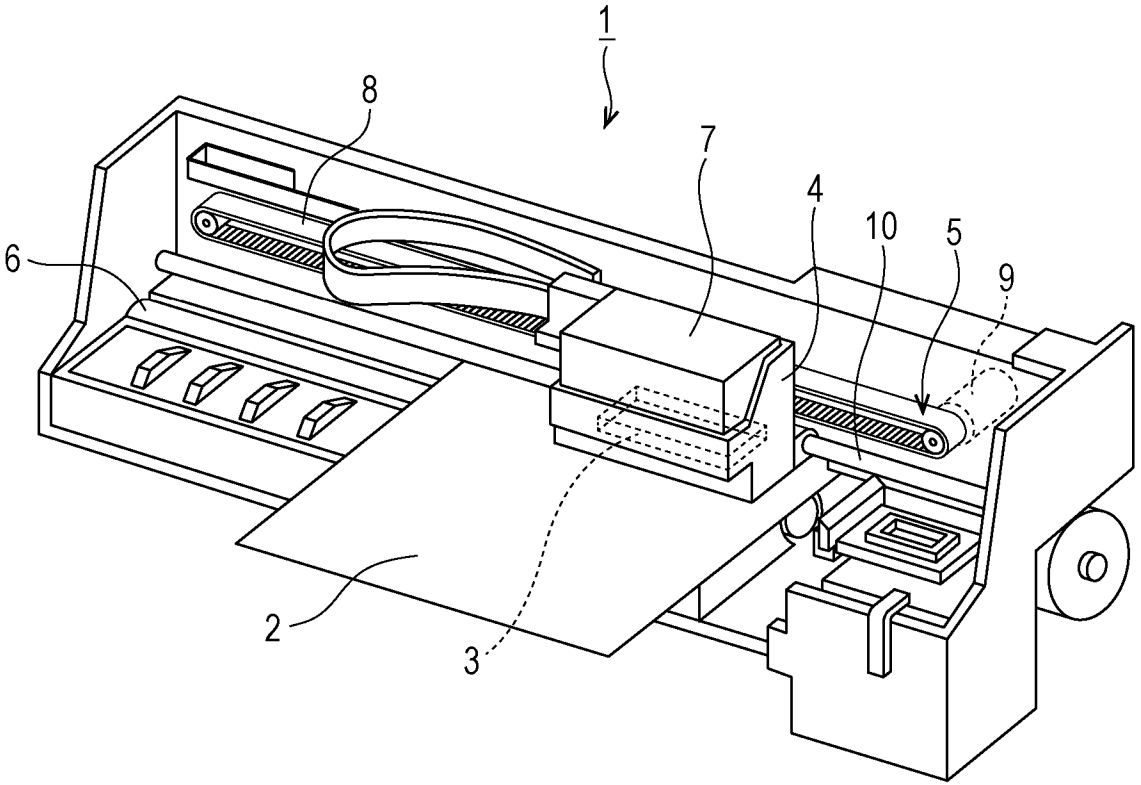
FIG. 1 is a perspective view illustrating an internal configuration of a printer.

A configuration of a printer 1 will be described with reference to FIG. 1. The printer 1 is an apparatus that records images and the like by ejecting ink in a liquid form to a surface of a recording medium 2 (a kind of an object on which to form deposits) such as recording paper. This printer 1 includes a recording head 3, a carriage 4 to which the recording head 3 is attached, a carriage moving mechanism 5 that moves the carriage 4 in a main scanning direction, a transport mechanism 6 that moves the recording medium 2 in a subsidiary scanning direction, etc. The aforementioned ink is a kind of a liquid according to the invention and is stored in an ink cartridge 7 provided as a liquid supply source. The ink cartridge 7 is detachably fitted to the recording head 3. Incidentally, a configuration in which the ink cartridge 7 is disposed on a main body side of the printer 1 and ink is supplied from the ink cartridge 7 to the recording head 3 through an ink supply tube can also be adopted.

The carriage moving mechanism 5 has a timing belt 8. The timing belt 8 is driven by a pulse motor 9 such as a direct-current (DC) motor. Therefore, when the pulse motor 9 operates, the carriage 4, guided by a guide rod 10 that is supported by and extends in the printer 1, is moved back and forth in the main scanning direction (the width direction of the recording medium 2).

Figure 2:
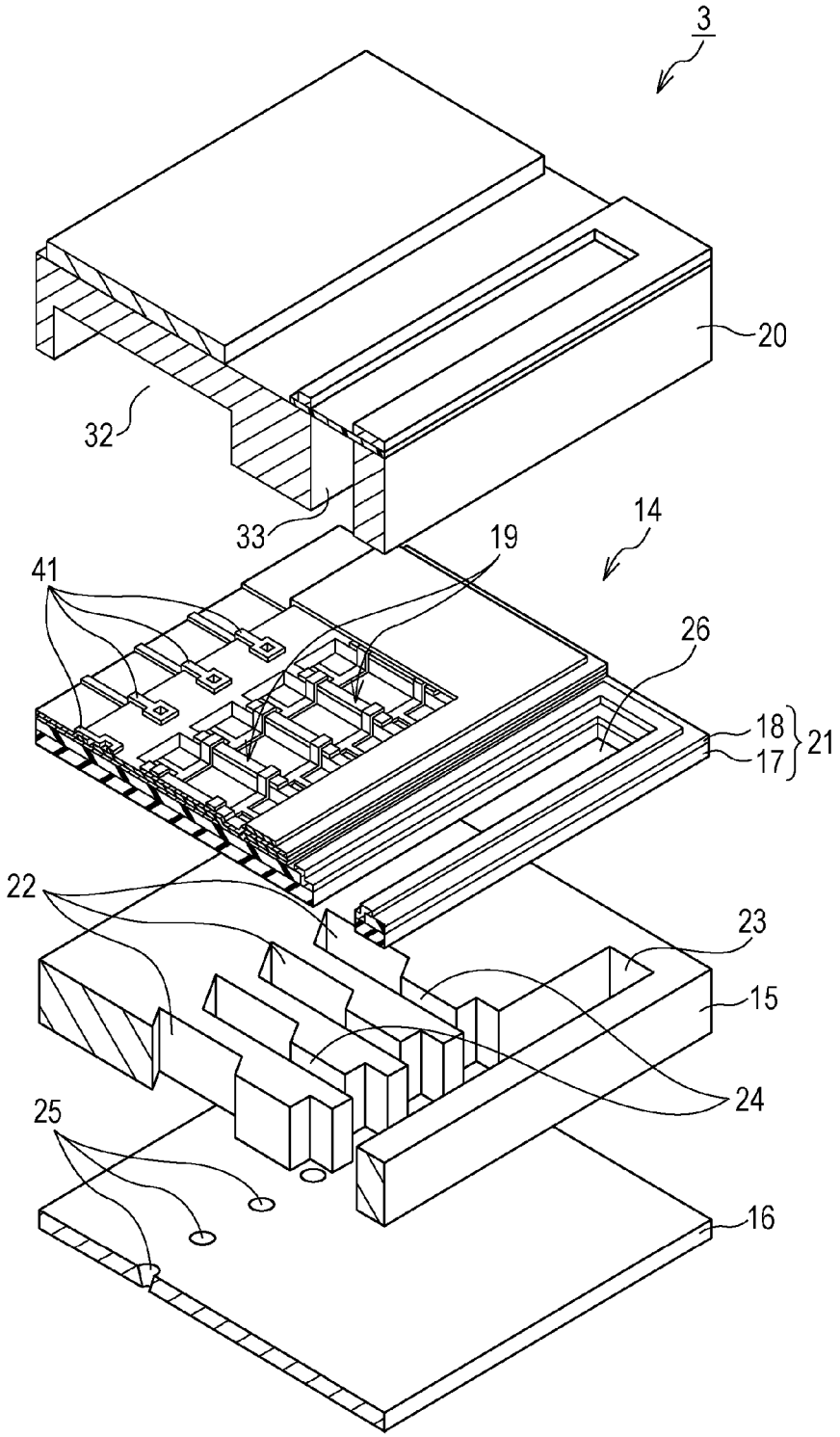
FIG. 2 is an exploded perspective view of a recording head.
Figure 3A:
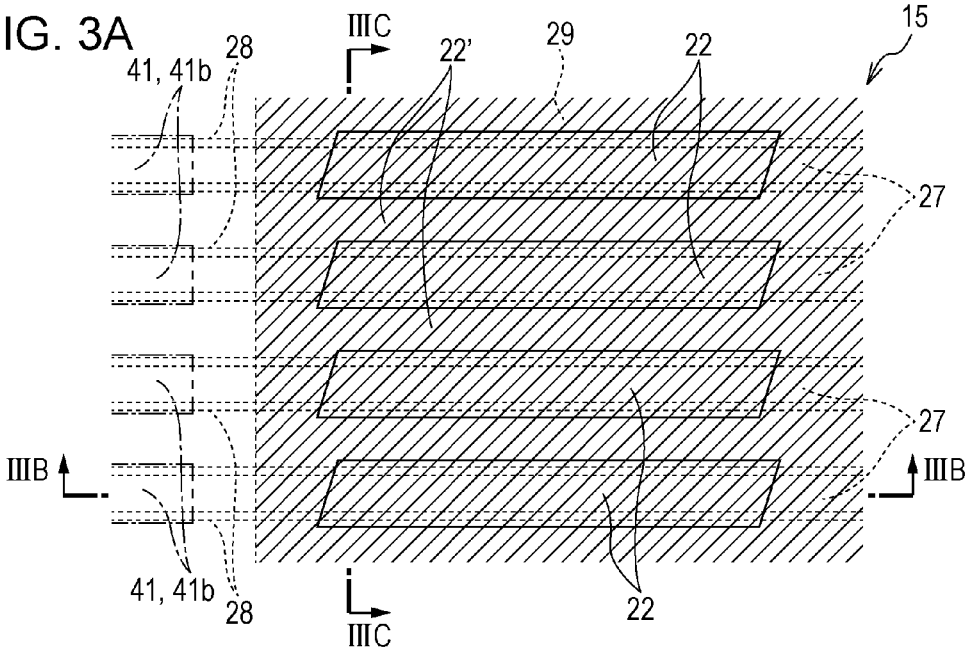
FIGS. 3A to 3C are diagrams illustrating portions of the recording head.
Figure 3B:
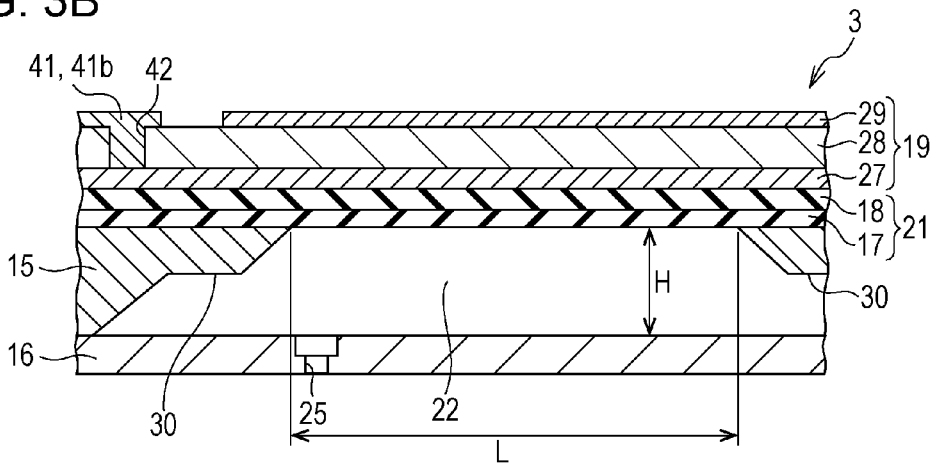
Figure 3C:
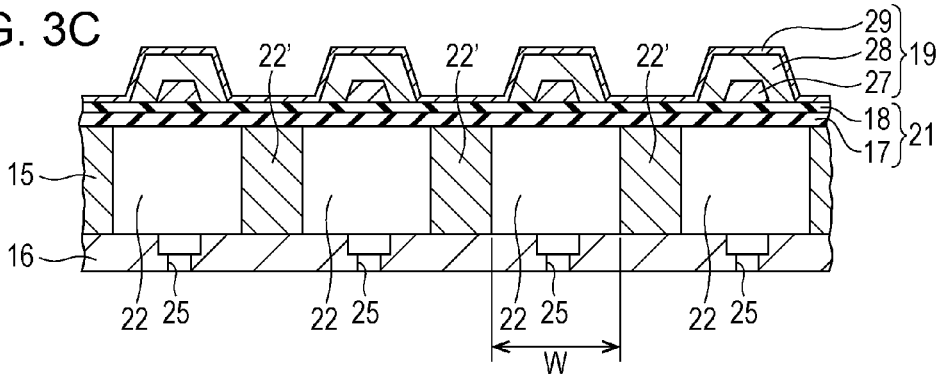

FIG. 2 is an exploded perspective view showing a configuration of the recording head 3 according to the embodiment. FIGS. 3A to 3C show configurations of portions of the recording head 3. FIG. 3A is a top view of a pressure chamber-forming substrate 15. FIG. 3B is a sectional view of portions of the recording head 3 taken on line IIIB-IIIB in FIG. 3A (a sectional view in a longitudinal direction of a pressure chamber). FIG. 3C is a sectional view of portions of the recording head 3 taken on line IIIC-IIIC in FIG. 3A (a sectional view in a short-dimension direction of pressure chambers). In FIG. 3A, a hatched area indicates a range in which an upper electrode film 29 (described below) is formed. Furthermore, although FIGS. 3A and 3C show a configuration that includes only four nozzles, configurations corresponding to other nozzles are substantially the same.

The recording head 3 in this embodiment is constructed by stacking a flow path-forming substrate 15 (a kind of a pressure chamber-forming member according to the invention), a nozzle plate 16, an actuator unit 14, a closure plate 20, etc. The flow path-forming substrate 15 in this embodiment is a plate member made of a silicon single crystal substrate. The flow path-forming substrate 15 has spaces that form a plurality of pressure chambers 22 (that correspond to spaces in the invention and that will hereinafter be referred to as "pressure chamber space"). The pressure chamber spaces are juxtaposed, with partition walls 22' sandwiched therebetween. The pressure chamber spaces are cavities elongated in a direction orthogonal to a nozzle array direction, and are provided in one-to-one correspondence with nozzles 25 of the nozzle plate 16. That is, the pitch at which the pressure chamber spaces (or the pressure chambers 22) are formed is equal to and in accordance with the pitch at which the nozzles 25 are formed. An upper opening of each pressure chamber space (which is an opening at a side opposite to a nozzle 25 side, and which corresponds to an opening in the invention) in the embodiment has a parallelogram shape. With regard to the dimensions of the pressure chamber spaces, a height H thereof (a dimension thereof in the stacking direction of recording head-constituting members. See FIG. 3B.) is set to 70 μm, and a width W of the upper opening of each pressure chamber space (a dimension of the upper opening in the nozzle array direction or the pressure chamber space juxtaposition direction in which the pressure chamber spaces are juxtaposed. See FIG. 3C.) is set to 70 μm. Furthermore, a length L of the upper opening of each pressure chamber space (a dimension thereof in a direction orthogonal to the nozzle array direction or to the pressure chamber space juxtaposition direction. See FIG. 3B.) is set to 360 μm. Therefore, the ratio of the length L to the width W of the upper opening of each pressure chamber space in this embodiment is 5.14:1. Details about the ratio of the length L and the width W of the pressure chamber spaces will be described later.

Furthermore, the pressure chamber spaces in this embodiment are formed by performing anisotropic etching on the flow path-forming substrate 15 from a lower surface side (nozzle plate 16 side), and internal wall surfaces of two end portions of each pressure chamber space in the longitudinal direction are oblique to upper and lower surfaces of the flow path-forming substrate 15. In more detail, these internal wall surfaces of the two opposite ends are inclined so as to approach each other toward the upper surface side. Furthermore, an intermediate portion of each internal wall surface is provided with a stepped portion 30. These stepped portions 30 are provided to prevent an adhesive on joint surfaces between the pressure chamber-forming substrate 15 and the nozzle plate 16 from creeping up toward the upper surface side, that is, toward an elastic film 17 (described below) of a vibration plate 21. Due to this configuration, the area of the upper opening of each pressure chamber space is smaller than the area of a lower opening thereof. Incidentally, a configuration in which each pressure chamber has neither a stepped portion nor an inclined internal wall surface, that is, a configuration in which the upper opening and the lower opening of each pressure chamber space have the same shape and dimensions, may instead be adopted.

As shown in FIG. 2, a region in the flow path-forming substrate 15 which is apart from the pressure chamber spaces to a side in the longitudinal direction of the pressure chambers (to the opposite side of the pressure chamber spaces to a side where each pressure chamber communicates with a corresponding one of the nozzles 25) is provided with a communication portion 23 that extends through the thickness of the flow path-forming substrate 15. The communication portion 23 is formed along the direction of juxtaposition of the pressure chamber spaces. This communication portion 23 is a cavity common to the pressure chamber spaces. The communication portion 23 communicates with the individual pressure chamber spaces via their respective ink supply paths 24. Incidentally, the communication portion 23 communicates with a communication opening portion 26 of the vibration plate 21 (described below) and with a liquid chamber cavity 33 of the closure plate 20, whereby a reservoir (common liquid chamber) that is an ink chamber common to the pressure chamber spaces (pressure chambers 22) is formed. The ink supply paths 24 have a narrower width than the pressure chamber spaces and provide flow path resistance against the ink that flows from the communication portion 23 into the pressure chamber spaces.

The nozzle plate 16 (nozzle-forming substrate) is joined, via an adhesive, a thermo-welding film, etc., to a lower surface of the flow path-forming substrate 15 (the surface on the opposite side thereof to the surface joined to the actuator unit 14). The nozzle plate 16 in this embodiment is provided with the nozzles 25 juxtaposed at a pitch (center-to-center distance between adjacent nozzles) that corresponds to a dot formation density of 300 dpi, that is, a pitch of 1/300 inch (84 μm). Therefore, the intervals at which the pressure chamber spaces communicating respectively with the nozzles 25 are formed are 1/300 inch. Each nozzle 25 communicates with a corresponding one of the pressure chamber spaces at an end portion thereof opposite the ink supply path 24. Incidentally, the nozzle plate 16 is made of, for example, a silicon single crystal substrate, stainless steel, etc.

The actuator unit 14 in this embodiment is constructed of the vibration plate 21 and piezoelectric elements 19. The vibration plate 21 is made up of the elastic film 17 made of silicon dioxide ($SiO_2$) which is formed on an upper surface of the flow path-forming substrate 15, and an insulator film 18 made of zirconium oxide ($ZrO_2$) which is formed on the elastic film 17. Portions of the vibration plate 21 that correspond to the pressure chamber spaces, that is, portions that close the upper openings of the pressure chamber spaces and partially define the pressure chambers 22, each function as a displacement portion that is displaced in a direction toward or away from the corresponding one of the nozzles 25 as the piezoelectric element 19 flexibly deforms. As shown in FIG. 2, a portion of the vibration plate 21 which corresponds to the communication portion 23 of the flow path-forming substrate 15 is provided with the communication opening portion 26 that communicates with the communication portion 23.

The piezoelectric elements 19 are formed on portions of the insulator film 18 of the vibration plate 21 which correspond to the pressure chamber spaces, that is, on the displacement portions (more specifically, on surfaces thereof on the side opposite to the nozzle size). The piezoelectric elements 19 in this embodiment have a configuration in which a lower electrode film 27 (corresponding to a first electrode in the invention), a piezoelectric body layer 28, and an upper electrode film 29 (corresponding to a second electrode in the invention) are stacked in order from the displacement portion side of the vibration plate 21 by using a film formation technology. Each piezoelectric element 19 extends on the insulator film 18, beyond an edge of the upper opening of a corresponding one of the pressure chamber spaces (an opening edge at the side of communication with the nozzle 25) to a position that is outwardly apart from the edge in the longitudinal direction of the pressure chamber spaces. The lower electrode film 27 and the piezoelectric body layer 28 extend beyond an end portion of the upper electrode film 29 in the pressure chamber longitudinal direction to a position outward in the same direction from the end portion. The lower electrode film 27 and the piezoelectric body layer 28 are divided to correspond to the individual pressure chambers 22 by patterning based on etching, such as lithography, ion milling, etc. Therefore, the lower electrode film 27 forms individual electrodes for each of the pressure chambers 22.

Furthermore, as shown in FIGS. 3A and 3C, the upper electrode film 29 is formed continuously in the pressure chamber juxtaposition direction (pressure chamber space juxtaposition direction) so as to cover the upper openings of the pressure chambers and the lower electrode film 27 above the upper openings. Thus, the upper electrode film 29 is an electrode common to the pressure chambers 22. Superposed sections in which the upper electrode film 29, the piezoelectric body layer 28, and the lower electrode film 27 are superposed are active portions in which piezoelectric strain occurs when voltage is applied to the two electrodes. The upper electrode film 29 is a common electrode for the piezoelectric elements 19, and the lower electrode film 27 forms individual electrodes for each piezoelectric element 19. In this construction, the lower electrode film 27 and the piezoelectric body layer 28 overlying the upper openings of the pressure chamber spaces are covered by the upper electrode film 29. The upper electrode film 29 also functions as a protective film that protects the piezoelectric body layer 28 in the active portions. That is, in the recording head 3 in this embodiment, it is not necessary to separately provide a protective layer for moisture resistance. Therefore, the entire thickness of the piezoelectric elements 19 can be reduced by an amount that corresponds to such a protective layer, so that it becomes possible to increase the amount of displacement of the entire piezoelectric elements 19. This consequently contributes to an increase of the expelled volume. The piezoelectric elements 19 in the foregoing construction are generally termed vibration-type piezoelectric elements that deform in the direction of the electric field. The piezoelectric elements 19 made by using the film formation technology can be reduced in size and therefore contribute to a size reduction of the liquid ejecting head in which the piezoelectric elements are mounted as pressure generators.

In order to facilitate comparison of the configuration of the recording head 3 in this embodiment with that of a recording head that has a protective layer, a configuration of a recording head disclosed in JP-A-2007-118193 mentioned above will be briefly described as a comparative example. The recording head disclosed in JP-A-2007-118193, similarly to the recording head 3, has a vibration plate made up of an elastic film (silicon dioxide) and an insulation film (zirconium oxide), and piezoelectric elements made up of a lower electrode film, a piezoelectric body layer and an upper electrode film that are stacked. Furthermore, in the recording head disclosed in JP-A-2007-118193, a moisture-resistant protective layer for protecting the piezoelectric elements is formed, covering the piezoelectric elements. With regard to the dimensions of various portions of the recording head disclosed in JP-A-2007-118193, the thickness of the elastic film is about 1.0 [μm], the thickness of the insulation film is about 0.3 to 0.4 [μm], the thickness of the lower electrode film is about 0.1 to 0.2 [μm], the thickness of the piezoelectric body layer is about 0.5 to 5 [μm], the thickness of the upper electrode film is about 0.1 [μm], and the thickness of the protective layer is about 0.1 [μm].

On the other hand, with regard to the dimensions of the vibration plate 21 and the piezoelectric elements 19 of the recording head 3 in this embodiment, the thickness of the elastic film 17 is about 1.3 to 1.4 [μm], the thickness of the insulator film 18 is about 0.3 to 0.4 [μm], the thickness of the lower electrode film 27 is about 0.1 to 0.2 [μm], the thickness of the piezoelectric body layer 28 is about 0.5 to 2 [μm], and the thickness of the upper electrode film 29 is set in the range of 30 to 70 [nm], as described below. As stated above, since the upper electrode film 29 covers the lower electrode film 27 and the piezoelectric body layer 28 and therefore functions also as a protective layer, there is no longer a need to separately provide a protective layer, and the thickness of the piezoelectric elements 19 as a whole is reduced compared with the related art.

Lead electrode portions 41 are formed at positions that are on the piezoelectric body layer 28 in a region extending outward in the pressure chamber longitudinal direction from the upper opening edges of the pressure chamber spaces and that are spaced by a predetermined distance from the upper electrode film 29 (positions on the left side in FIGS. 3A and 3B). At the positions at which the lead electrode portions 41 are formed in the piezoelectric body layer 28, as shown in FIG. 3B, through holes 42 are formed which extend through the piezoelectric body layer 28, from an upper surface of the piezoelectric body layer 28 to the lower electrode film 27. The lead electrode portions 41 are patterned corresponding to the lower electrode film 27 provided as individual electrodes. The lead electrode portions 41 are electro-conductively connected to the lower electrode film 27 through the through holes 42. Via the lead electrode portions 41, a drive voltage (drive pulse) is selectively applied to the piezoelectric elements 19.

As shown in FIG. 2, the closure plate 20 having a housing cavity 32 capable of housing the piezoelectric elements 19 is joined to an upper surface of the actuator unit 14 which is opposite to a lower surface of the actuator unit 14 which is a joint surface joined to the flow path-forming substrate 15. This closure plate 20 is a hollow box-shaped member whose housing cavity 32 has an opening in the lower surface side that is the joint surface side joined to the actuator unit 14. The aforementioned housing cavity 32 is a recess extending from the lower surface side of the closure plate 20 to the upper surface side, more specifically, to an intermediate location in the height direction of the closure plate 20. Furthermore, the closure plate 20 is provided with the liquid chamber cavity 33 that is formed in a region in the closure plate 20 which is located at a position outwardly apart from the housing cavity 32 in a direction orthogonal to the nozzle array and which corresponds to the communication opening portion 26 of the vibration plate 21 and the communication portion 23 of the flow path-forming substrate 15. The liquid chamber cavity 33 extends through the closure plate 20 in the thickness direction so as to lie in the juxtaposition direction of the pressure chamber spaces (pressure chambers 22). As described above, the liquid chamber cavity 33 communicates with the communication opening portion 26 and the communication portion 23 in series, and defines together therewith the reservoir that forms the common ink chamber for the pressure chamber spaces. Incidentally, although not shown in the drawings, the closure plate 20 is provided with not only the housing cavity 32 and the liquid chamber cavity 33, but also wiring opening portions that extend through the closure plate 20 in the thickness direction. In the wiring opening portions, end portions of the lead electrode portions 41 are exposed. Terminals of wiring members (not shown) from the main body of the printer are electrically connected to the exposed portions of the lead electrode portions 41.

In the recording head 3 constructed as described above, ink is taken from the ink cartridge 7 to fill the flow path that includes the reservoir, the ink supply paths 24, the pressure chambers 22, and the nozzles 25. Then, when a drive signal is supplied from the printer main body, an electric potential difference is created between the lower electrode film 27 and the upper electrode film 29 of each of specified piezoelectric elements 19, thereby creating a commensurate electric field therebetween, which causes displacement of the piezoelectric element 19 and therefore the displacement portions of the vibration plate 21, so that pressure fluctuation occurs in the pressure chambers 22 adjacent to the specified piezoelectric elements 19. By controlling this pressure fluctuation, ink is ejected from the nozzles 25.

In the recording head 3 according to the invention, the expelled volume of the pressure chambers 22 at the time of driving the piezoelectric elements 19 is increased while the entire recording head 3 is reduced in size. Specifically, the expelled volume is increased by increasing the amount of displacement of the piezoelectric elements 19 and by improving the displacement efficiency of the displacement portions of the vibration plate 21 that closes the upper openings of the pressure chamber spaces. This will be described in more detail below.

First, optimization of the aspect ratio of the upper opening of each pressure chamber space, that is, the ratio between the length L and the width W of the upper opening of each pressure chamber space, will be described. In relatively small recording heads whose nozzles are formed at a high density of 1/300 inch or less in the aforementioned formation pitch as in the recording head 3 in the embodiment, the capacity of the pressure chambers is accordingly limited. Particularly, the width of the pressure chambers, which is determined according to the nozzle formation pitch and the rigidity of partition walls (the required thickness thereof) that partition the pressure chambers, cannot be greatly changed. In order to secure a larger expelled volume under such conditions, it is desirable to improve the displacement efficiency (i.e., the ease of displacement) of the displacement portions displaceable according to the driving of the piezoelectric elements in the vibration plate that tightly closes the upper openings of the pressure chambers. Therefore, as for the recording head 3 in the embodiment, the dimensions of the pressure chamber spaces are determined so that the ratio of the length L to the width W of the upper opening of each pressure chamber space is within the range of 4.3 or greater to 6.0 or less. That is, in order to increase the expelled volume, it is desirable to adopt an appropriate aspect ratio of the upper openings of the pressure chamber spaces such that the displacement efficiency of the displacement portions will be improved, instead of simply increasing the area of the upper openings.

FIG. 4 is a table based on various examples and shows dimensions of the upper openings of pressure chamber spaces (the length L [μm], and the aspect ratio (L/W)), the amount of displacement [nm] of the displacement portions of piezoelectric elements 19 occurring at the time of application of a certain voltage, and the rate of increase [%] in the amount of displacement compared with a comparative example. In the table, the width W of the upper opening of each pressure chamber space was fixed at 70 [μm]. Furthermore, the configuration of the comparative example was a recording head having a configuration similar to that of the recording head 3 of the embodiment. In the comparative example, the length L of the upper opening of each pressure chamber was set to 700 [μm], and the width W thereof was set to 70 [μm]. The thickness of the upper electrode film was 100 [nm] in both the examples of the embodiment and the comparative example. In the comparative example, the aspect ratio was 10, and the amount of displacement was about 408 [nm]. Furthermore, the amounts of displacement of the piezoelectric elements 19 and the displacement portions were measured using, for example, a laser displacement gauge.

As shown in FIG. 4, if the aspect ratio L/W was changed by changing the length L of the upper opening of the pressure chamber space against the fixed width (70 [μm]) of the upper opening of the pressure chamber space, the amount of displacement changed accordingly. More specifically, it can be understood that in the case where the length L of the upper opening of the pressure chamber was 360 [μm] and the aspect ratio was 5.14 (the pressure chamber indicated by a bold outline in FIG. 4 (best mode)), the largest amount of displacement of 600 [nm] and the largest rate of increase of 47 [%] were obtained, and that as the aspect ratio decreased or increased from 5.14, the displacement efficiency gradually decreased. It is to be noted herein that if the aspect ratio was in the range of 4.28 (≈4.3) or greater to 6.0 or less, the rate of increase changed by an amount equal to or less than 5 [%] for a change of 10 [μm] in the length L of the pressure chamber space, and that if the aspect ratio was outside the aforementioned range (the pressure chamber spaces indicated by hatching in FIG. 4), the rate of increase changed sharply by an amount greater than 5 [%] for a change of 10 [μm] in the length L. Therefore, if the aspect ratio was within the range of 4.3 or greater to 6.0 or less, relatively good results that the rate of increase in the amount of displacement compared with the comparative example was 37 [%] or greater were obtained. Incidentally, with regard to the dimensions (the width W and the length L) of the upper openings of the pressure chambers, it is assumed that a tolerance of about ±10 [%] is allowed.

Thus, by setting the aspect ratio of the upper opening of a pressure chamber space within the range of 4.3 or greater to 6.0 or less, the amounts of displacement of the piezoelectric element 19 and the displacement portion of the vibration plate 21 that tightly closes the upper opening can be increased even if the length L of the pressure chamber space is shorter and the opening area of the pressure chamber space is smaller than in the related art. This makes it possible to increase the expelled volume that occurs when the piezoelectric element 19 is driven, while reducing the capacity of the pressure chamber spaces (pressure chambers 22) so as to allow size reduction of the recording head. Furthermore, by setting the aspect ratio to 5.14, the displacement efficiencies of the piezoelectric element 19 and the displacement portion can be more effectively enhanced. Therefore, it becomes possible to further increase the expelled volume.

In the recording head 3 according to the invention, the displacement efficiency of the piezoelectric elements 19 is improved by revising the design of the piezoelectric elements 19, in addition to optimizing the aspect ratio of the upper openings of the pressure chambers 22 (setting the aspect ratio within the range of 4.3 or greater to 6.0 or less). Specifically, setting the thickness of the upper electrode film 29 to 100 [nm] or less contributes to improvement in the displacement efficiencies of the piezoelectric elements 19 and the displacement portions, and therefore can further increase the expelled volume. Furthermore, it is desirable that the thickness of the upper electrode film 29 be set within the range of 30 [nm] or greater to 70 [nm] or less (from 0.030 [μm] or greater to 0.070 [μm] or less), which will further increase the amounts of displacement of the piezoelectric elements 19 and the displacement portions. As a result, further increase of the expelled volume can be expected.

FIG. 5 is a table based on various examples and shows the thicknesses [nm] of upper electrode films 29, the amounts of displacement [nm] of piezoelectric elements 19 and displacement portions occurring at the time of application of a fixed voltage, and the rates of increase [%] in the amount of displacement compared with a comparative example. In the table, the width W of the upper openings of the pressure chamber spaces was 70 [μm] and the length L thereof was 360 [μm] (i.e., the best mode shown in FIG. 4). The configuration of the comparative example was similar to the configurations of the examples shown in FIG. 5, except for the thickness of the upper electrode film 29, that is, the thickness of the upper electrode film 29 in the comparative example was set to 100 [nm] (0.1 [μm]). In this comparative example, the amount of displacement was about 600 [nm].

As shown in FIG. 5, it can be understood that the thinner the thickness of the upper electrode film 29, the larger the amount of displacement. That is, by setting the thickness of the upper electrode film 29 within the range of 30 [nm] or greater to 70 [nm] or less, the amount of displacement of the piezoelectric element 19 increased by 25 [%] or more, and by a rate of about 32 [%] at maximum (the best mode indicated by a bold outline in FIG. 5). However, if the thickness of the upper electrode film 29 exceeded 70 [nm], the rate of increase decreased greatly. Specifically, in that case, the rate of increase decreased by a rate of change greater than 2% for an amount of change of 10 [nm] in the film thickness. Incidentally, if the thickness of the upper electrode film 29 was less than 30 [nm], the film thickness of the upper electrode film 29 could not be stably obtained; therefore, in conjunction with this evaluation, no experiment was conducted for the case where the thickness of the upper electrode film 29 was less than 30 [nm]. Therefore, the aforementioned range of the thickness of the upper electrode film 29 can be said to be such a range thereof that the displacement efficiencies of the piezoelectric elements 19 and the displacement portions can be more effectively improved without impairing the reliability of the piezoelectric elements.

Thus, setting the thickness of the upper electrode film 29 within the range of 30 [nm] or greater to 70 [nm] or less contributes to further increases in the amounts of displacement of the displacement portions and the piezoelectric elements 19 without impairing the reliability of the piezoelectric elements 19. In particular, by setting the thickness of the upper electrode film 29 to 30 [nm], the displacement efficiencies of the piezoelectric elements 19 and the displacement portions can be still further enhanced. Therefore, it becomes possible to still further increase the expelled volume.

Figure 6:
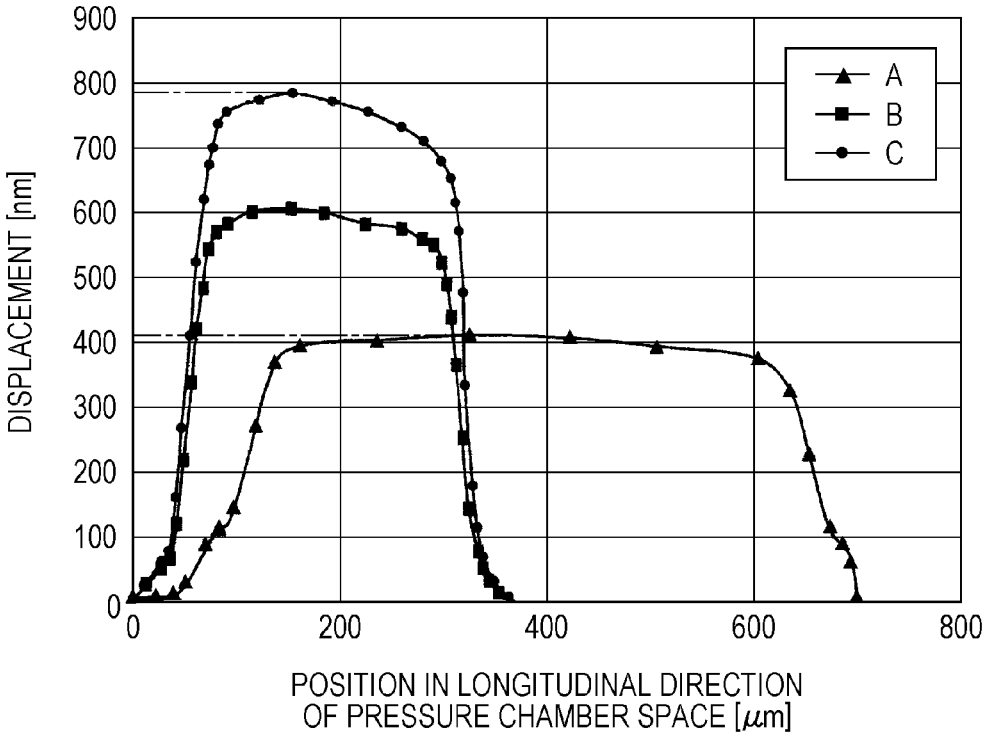
FIG. 6 is a graph showing relations of the aspect ratios of upper openings of pressure chamber spaces and the thicknesses of upper electrode films to the amounts of displacement of the piezoelectric elements and the displacement portions.

FIG. 6 is a graph showing relations between the position of the upper opening of a pressure chamber space in the longitudinal direction and the amount of displacement [nm] of the piezoelectric element 19 and the displacement portion occurring at the time of applying a fixed voltage in three recording heads. In this graph, the horizontal axis represents the position in the longitudinal direction of the upper opening of the pressure chamber. For example, an end portion of the upper opening at the side of communication with the nozzle 25 is represented by the origin 0, and the numerical value regarding the position is set so as to increase toward the ink supply path-side end portion thereof. Incidentally, the width W was fixed at 70 [μm]. Furthermore, the vertical axis represents the amount of displacement [nm] of a piezoelectric element 19 and a displacement portion at a predetermined position in the longitudinal direction of the pressure chamber. It is to be noted herein that a recording head corresponding to line A in FIG. 6 is a comparative example having a configuration in which the thickness of the upper electrode film was 100 [nm], the length L of the upper opening of each pressure chamber was 700 [μm], and a protective layer was not provided. Furthermore, a recording head corresponding to line B in FIG. 6 is an example having a configuration in which the thickness of the upper electrode film was 100 [nm], and the length L of the upper opening of each pressure chamber was 360 [μm]. A recording head corresponding to line C FIG. 6 is an example having a configuration in which the thickness of the upper electrode film was 30 [nm], the length L of the upper opening of each pressure chamber was 360 [μm] as in the recording head of line B, and a protective layer was not provided. In the recording head indicated by line A, the aspect ratio of the upper opening of each pressure chamber space was 10, which is far out of the range of 4.3 or greater to 6.0 or less, which is a condition according to the invention. If the length L of the upper opening of a pressure chamber space is excessively great relative to the width W thereof as in this comparative example, the displacement efficiency of the displacement portion becomes inconveniently low. Therefore, the amount of displacement in the comparative example was at most 408 [nm] as indicated in FIG. 6.

In contrast, in the recording head indicated by line B, the aspect ratio of the upper opening of each pressure chamber space was within the range of 4.3 or greater to 6.0 or less, and specifically 5.14, which is the best mode. Therefore, compared with the recording head of line A, the piezoelectric elements and the displacement portion in the recording head of line B were more easily movable. Specifically, a maximum amount of displacement of 600 [nm] was obtained. In the case of the recording head of line B, the rate of increase in the amount of displacement compared with the recording head of line A was about 47 [%]. In the recording head of line C, the thickness of the upper electrode film was set to 30 [nm], which was considerably less than the thickness of the upper electrode film in the recording head of line B. Therefore, the piezoelectric elements and the displacement portions in the recording head of line C were even more easily movable. Therefore, a maximum amount of displacement of 786 [nm] was obtained. In the case of the recording head of line C, the rate of increase in the amount of displacement compared in terms of peak value with the recording head of line B was 31 [%]. Furthermore, in comparison with the recording head of line A, the amount of displacement in the best mode of the recording head of line C increased by about 92% (to about double).

Incidentally, the invention is not limited to the foregoing embodiments, but can be modified in various ways according to the description in the appended claims.

For example, although in the foregoing embodiments, the upper opening of each pressure chamber space has a parallelogram shape as an example, the shape of the upper opening of each pressure chamber space is not limited thereto, but may be any shape, as long as the shape allows the aspect ratio to be accordingly determined. Furthermore, although in the embodiments, the recording head 3 has a configuration in which the nozzles 25 are juxtaposed in a line, the invention is not limited to this configuration, but may be applied to a configuration in which nozzles are juxtaposed obliquely to the main scanning direction, which is the moving direction of the recording head 3, or the subsidiary scanning direction, which is the transporting direction of the recording medium, a construction in which nozzles are arranged in a matrix form, etc. If, in such a configuration, the minimum distance (center-to-center distance) between nozzles is 1/300 inch or less, an issue similar to the one in the foregoing embodiment arises. However, this issue can be solved by setting the aspect ratio of the upper openings of the pressure chambers and the structure of the piezoelectric elements (regarding a protective layer (presence/absence thereof), and the thickness of the upper electrode film) similarly to those in the foregoing embodiment, and therefore advantageous effects similar to those of the recording head 3 of the embodiment can be expected.

Furthermore, the foregoing embodiments have been described in conjunction with the ink jet recording head that is to be mounted in an ink jet printer. However, the invention is also applicable to any apparatus that ejects a liquid other than ink as long as the apparatus has a piezoelectric element and a pressure chamber that are constructed as described above. For example, the invention is applicable to color material ejecting heads for use in producing color filters for liquid crystal displays and the like, electrode material ejecting heads for use in forming electrodes of organic electro-luminescence (EL) displays, surface emitting displays (SEDs), etc., bioorganic material ejecting heads for use in producing bio-chips (biochemical devices), etc.

What is claimed is:

1. A liquid ejecting head comprising:

a pressure chamber-forming member provided with a plurality of spaces each of which communicates with a nozzle and forms a pressure chamber; and a piezoelectric element in which a first electrode, a piezoelectric body layer, and a second electrode are stacked in order from a side relatively near to a displacement portion that tightly closes an opening of at least one of the spaces formed in the pressure chamber-forming member and that defines a portion of the pressure chamber, wherein the piezoelectric element is driven to displace the displacement portion so that pressure change is caused in a liquid within the pressure chamber and is utilized to eject the liquid from the nozzle, and wherein a ratio of a length of the opening in a direction orthogonal to a pressure chamber space juxtaposition direction in which the spaces are juxtaposed to a width of the opening in the pressure chamber space juxtaposition direction is greater than or equal to 4.3 and less than or equal to 6.0.

2. The liquid ejecting head according to claim 1, wherein the first electrode is provided individually for each pressure chamber, and the second electrode extends over a plurality of piezoelectric elements in the pressure chamber space juxtaposition direction, covers the first electrode and the piezoelectric body layer of each piezoelectric element, and is common to the plurality of piezoelectric elements.

3. A liquid ejecting apparatus comprising the liquid ejecting head according to claim 2.

4. The liquid ejecting head according to claim 1, wherein a film thickness of the second electrode is 100 [nm] or less.

5. A liquid ejecting apparatus comprising the liquid ejecting head according to claim 4.

6. The liquid ejecting head according to claim 1, wherein a plurality of nozzles are formed at a formation pitch of 1/300 inch or less.

7. A liquid ejecting apparatus comprising the liquid ejecting head according to claim 6.

8. The liquid ejecting head according to claim 1, wherein a thickness of the second electrode is greater than or equal to 30 [nm] and less than or equal to 70 [nm].

9. A liquid ejecting apparatus comprising the liquid ejecting head according to claim 8.

10. The liquid ejecting head according to claim 1, wherein the ratio of the length of the opening of the space to the width of the opening is 5.14.

11. A liquid ejecting apparatus comprising the liquid ejecting head according to claim 10.

12. A liquid ejecting apparatus comprising the liquid ejecting head according to claim 1.

* * * * *